US008550928B2

(12) United States Patent
Hamelin

(10) Patent No.: US 8,550,928 B2
(45) Date of Patent: Oct. 8, 2013

(54) WATER PLAY INSTALLATION

(75) Inventor: Stephen Hamelin, L'Ile Cadieux (CA)

(73) Assignee: Stella Hamelin Holdings Inc., Pointe-Claire (CA)

( * ) Notice: Subject to any disclaimer, the term of this patent is extended or adjusted under 35 U.S.C. 154(b) by 252 days.

(21) Appl. No.: 12/992,772

(22) PCT Filed: May 13, 2009

(86) PCT No.: PCT/CA2009/000651

§ 371 (c)(1),
(2), (4) Date: Nov. 15, 2010

(87) PCT Pub. No.: WO2009/137922

PCT Pub. Date: Nov. 19, 2009

(65) Prior Publication Data

US 2011/0071689 A1 Mar. 24, 2011

(30) Foreign Application Priority Data

May 13, 2008 (CA) ..... 2631252

(51) Int. Cl.
*A63G 31/00* (2006.01)
*A63G 3/00* (2006.01)

(52) U.S. Cl.
USPC ..... 472/128; 239/17

(58) Field of Classification Search
USPC ..... 472/117, 128, 129, 13, 59; 239/16–18, 239/20, 22, 23, 67, 93, 101, 211
See application file for complete search history.

(56) References Cited

U.S. PATENT DOCUMENTS

| | | | | |
|---|---|---|---|---|
| 4,858,827 | A | 8/1989 | Fletcher et al. | |
| 6,261,186 | B1 * | 7/2001 | Henry | 472/128 |
| 6,375,090 | B1 | 4/2002 | Beidokhti | |
| 6,702,687 | B1 | 3/2004 | Henry | |

OTHER PUBLICATIONS

Written Opinion of PCT/CA2009/000651.
International Search Report of PCT/CA2009/000651.

* cited by examiner

*Primary Examiner* — Kien Nguyen
(74) *Attorney, Agent, or Firm* — Brouillette & Partners; François Cartier; Robert Brouillette

(57) ABSTRACT

A participatory water play installation comprises a water play area provided with several water dispensing elements which can be user-activated via a user interface connected to a command center. The command center is preferably located underneath the water play area and further comprises an electronic system controller, electrically actuated solenoid valves and a water distribution manifold. The command center is in fluid communication with the water dispensing elements whereby upon stimulation of the user interface, the command center initiates a predetermined sequence of water dispensing patterns from the activated water dispensing elements, resulting in recreational enjoyment of the participants.

18 Claims, 3 Drawing Sheets

WATER PLAY INSTALLATION

CROSS-REFERENCE TO RELATED APPLICATIONS

The present patent application claims the benefits of priority of commonly assigned Canadian Patent Application No. 2,631,252, entitled "WATER PLAY INSTALLATION" and filed at the Canadian Intellectual Property Office on May 13, 2008.

FIELD OF THE INVENTION

The present invention generally relates to participatory water play structures, systems, apparatuses and installations where participants can play and/or interact with water dispensing elements for recreational enjoyment.

BACKGROUND OF THE INVENTION

Over the past 15 years, cities, amusement parks, hotels, and other facilities catering to family recreation and leisure have been installing zero-depth aquatic or water play area installations. These installations are generally referred to as splash pads, spray parks, spray grounds and wet decks (hereinafter "water play area installation"). These play area installations are typically provided with water dispensing elements and structure such as, but not limited to, water canons, spray arches, ground sprays, and the like. U.S. Pat. Nos. 5,194,048; 5,405,294 and 5,662,525 disclose examples of prior art water play area installations.

Typically, in prior art water play area installations, the water dispensing elements are generally configured to be activated by participants using one or several user interfaces located in the designated play area as an independent device or integrated into one or several water dispensing elements. In certain of these installations, the user interfaces are in electric communication with a system controller which controls electrically or hydraulically activated solenoid valves connected to a water distribution manifold.

In use, participants touch, engage or act upon the user interface which sends signals to the system controller which, in response, opens and/or close the valves in accordance with one or more pre-programmed sequences in order to feed the activated water dispensing elements with water.

In conventional water play area installations, especially those comprising electronic systems, the system controller, the solenoid valves and the water distribution manifold are typically installed in a building, in an underground enclosure, or in an aboveground enclosure installed at a significant distance from the water play area. This configuration is understandable since it is generally most preferable to avoid contact between water and electric and electronic systems. However, in these conventional water play area installations, since the user interfaces are usually located on the water play area, electrical wiring must still be installed between the user interfaces and the system controller.

Accordingly, conventional water play area installations require the independent installation of the user interfaces, the system controller and the water distribution manifold. Moreover, they require space for the installation of these equipments, which is not always available, and they require the installation of electrical wiring from the system controller to the activation devices, and water piping from the manifold to water dispensing elements. Hence, despite ongoing development, there is still a need for a novel water play installation which mitigates the shortcomings of the prior art.

SUMMARY OF THE INVENTION

The aforesaid shortcomings are generally mitigated by providing a novel water play installation wherein the user interface, the system controller and the water distribution manifold are integrated into a command center generally located in close proximity and preferably underneath the water play area, thereby defining an elegant and compact structure.

More particularly, a water play installation in accordance with the present invention generally comprises a water play area provided with preferably several water dispensing elements. Though the water dispensing elements may vary in form, shape and configuration, each water dispensing element is adapted to dispense water. Examples of water dispensing elements are water canons, spray arches, ground sprays, water tunnels and water sprinklers. Understandably, the foregoing list is not exhaustive and other forms of water dispensing elements could be provided. The water dispensing elements are generally disposed on the play area such as to define an entertaining and ludic environment.

In accordance with the present invention, the water dispensing elements are all fluidly connected to a command center preferably located in close proximity of the periphery of the play area and most preferably located underneath the water play area in a central region thereof. The command center generally comprises an enclosure having a bottom wall, one or more side walls and a top cover which define an inner chamber into which are located an electronic system controller, one or more preferably electrically actuated solenoid valves and a water distribution manifold to which is connected a water supply line. Understandably, the water dispensing elements are connected to the water distribution manifold via the solenoid valves.

In accordance with the present invention, the command center further comprises a user interface connected to the system controller and used to activate the water dispensing elements via the system controller. Understandably, different types of user interface could be used; for example, motion detector, pressure sensor, tactile screen, etc.

According to another aspect of the present invention, the command center can contain an integrated drainage system to collect the water dispensed by the water dispensing elements. The enclosure is therefore preferably, though not necessarily, provided with draining pipes preferably connected to a water recovery system.

In use, participants would go on the water play area and would activate the water play installation by acting upon the user interface of the command center. In response, the user interface would send one or more signals to the system controller which would turn on or off the solenoid valves in order to supply water to the water dispensing elements in accordance with one or more predetermined programs stored in the system controller.

As the skilled addressee would readily understand, a sound system and/or a lighting system could also be connected to the system controller for providing sound and/or lighting effects for additional enjoyment.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel water play installation will be described hereinafter. Although the invention is described in terms of specific illustrative embodiments, it is to be understood that the embodiments described herein are by way of example only and that the scope of the invention is not intended to be limited thereby.

Figure 1:
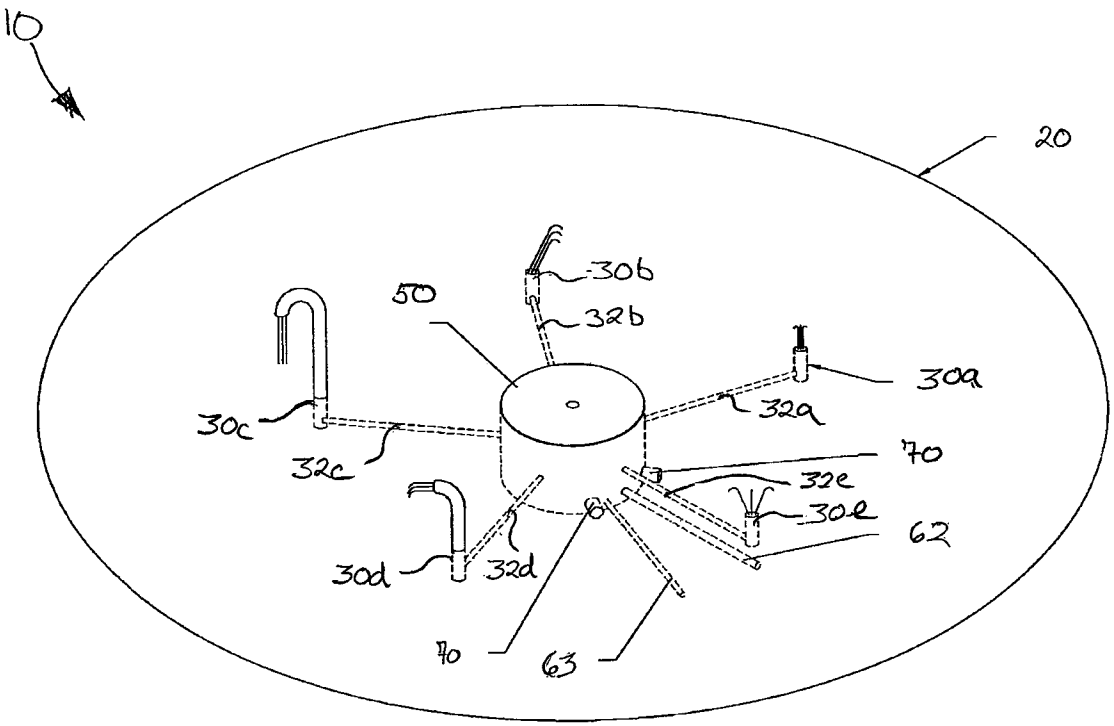
FIG. 1 is a perspective view of an exemplary embodiment of a water play installation in accordance with the present invention.

Referring first to FIG. 1, a broad perspective view of an embodiment of the water play installation 10 of the present invention is shown. The water play installation 10 typically comprises a water play area 20 generally made from one or more slabs of concrete though other materials could be used.

Disposed on the water play area 20 are several water dispensing elements 30. Though only five (elements 30*a*, 30*b*, 30*c*, 30*d* and 30*e*) such water dispensing elements 30 are shown in FIG. 1, it is to be understood that this number is illustrative and that more or less water dispensing elements 30 could be provided. The number and disposition of the water dispensing elements 30 are generally chosen according to the available space and in order to define an entertaining and ludic environment. Typically, the water dispensing elements 30 are structures of various shapes and configurations which are all adapted to dispense water.

Non limitative examples of water dispensing elements 30 include water canons, water mist generators, ground sprays, water falls, etc. Understandably, water dispensing elements 30 could be more or less complex depending on the desired water effect. The present invention is not so limited.

Figure 4:
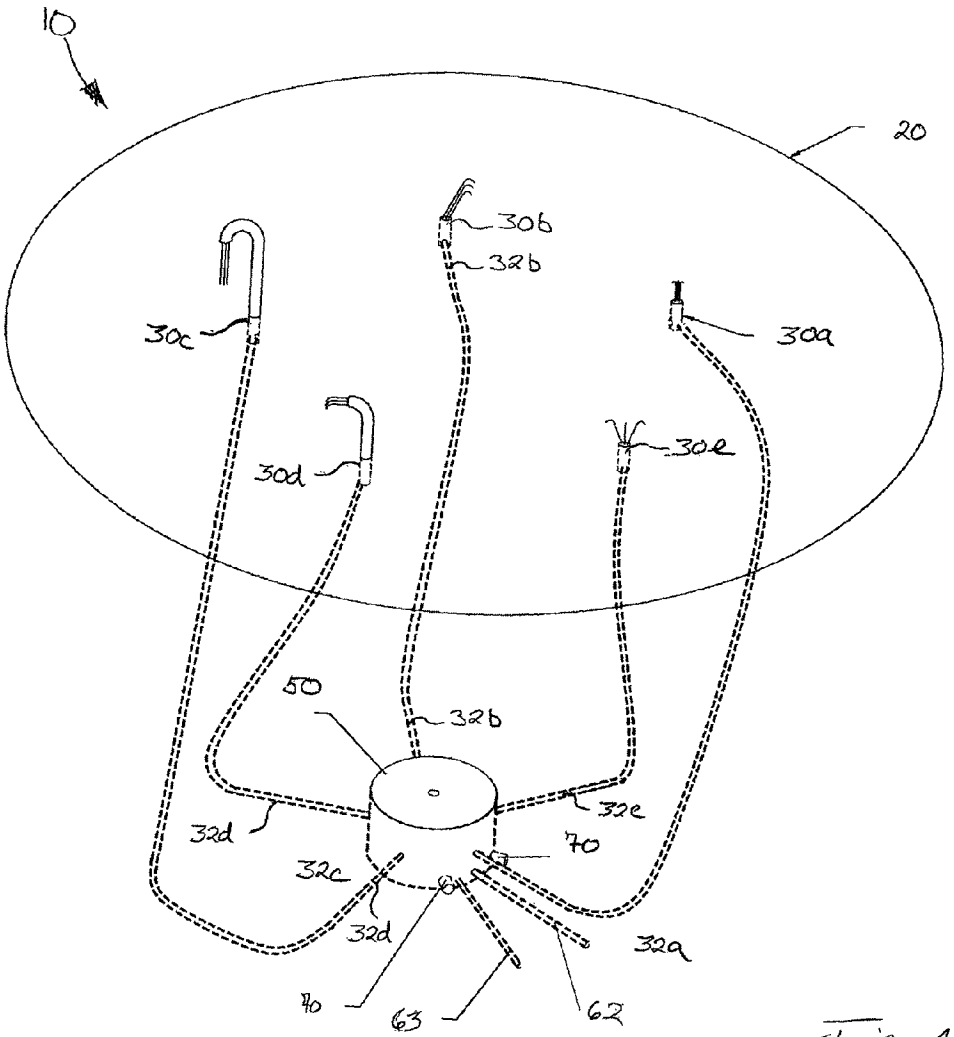
FIG. 4 is a perspective view of another exemplary embodiment of a water play installation in accordance with the present invention.

Still referring to FIG. 1, each water dispensing element 30 is fluidly connected to a command center 50 via water feed line 32. As depicted in FIG. 1, the command center 50 is preferably, but not exclusively, approximately located in a central region of the water play area 20. The command center 50 is also preferably substantially located underneath the surface of the water play area 20. Still, in certain embodiments as the one depicted in FIG. 4, the command center could possibly be located outside the water play area though near its periphery. In those embodiments, the command center should be located within 10 meters of the periphery, preferably within 5 meters, and most preferably within 1 meter.

Figure 2:
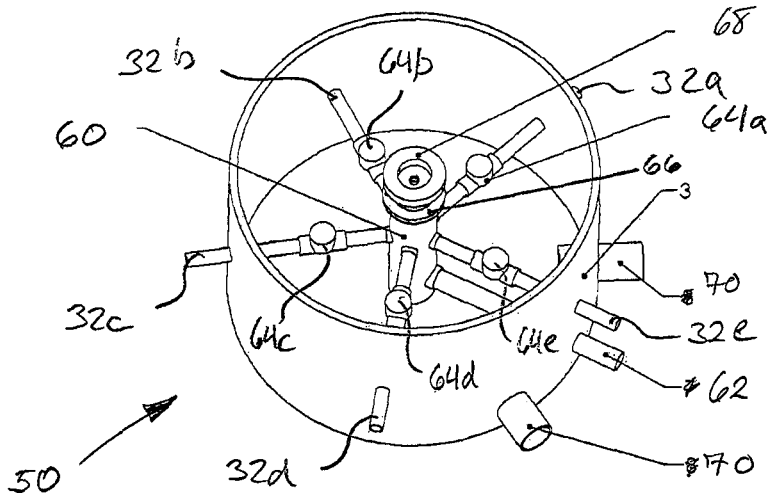
FIG. 2 is a perspective view of the command center of the water play installation of FIG. 1.
Figure 3:
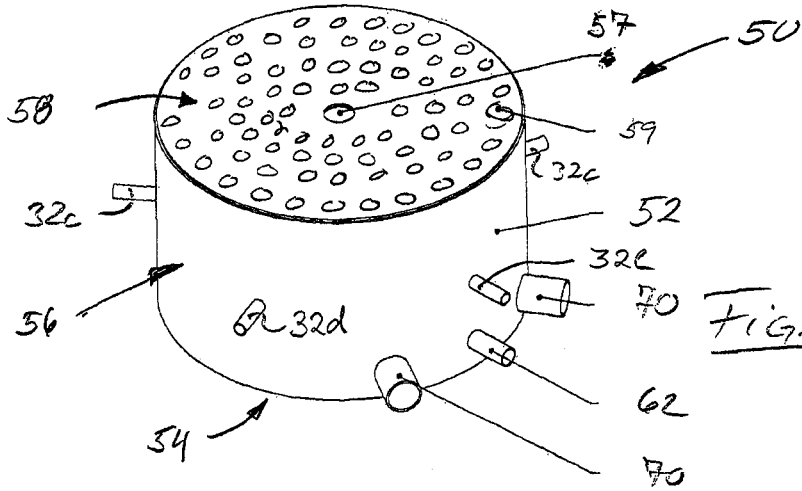
FIG. 3 is a perspective view of the command center of the water play installation of FIG. 1, with the cover installed.

Referring now to FIGS. 2 and 3, the command center 50 generally comprises an enclosure 52 having bottom wall 54, side wall 56 and preferably removable cover 58. The enclosure 52 defines an inner space into which is located a water distribution manifold 60. The manifold 60 is fed with water through a water supply line 62 connected to a water source (not shown). The manifold 60 is further connected to the water feed lines 32 of the water dispensing elements 30 via preferably electrically actuated solenoid valves 64. As best shown in FIG. 2, each water feed line 32 preferably has its own valve 64 such that each water dispensing element 30 can independently be fed with water. The present invention is however not so limited. Indeed, a valve 64 could possibly feed more than one water feed lines 32 with the use of appropriate pipes and couplings.

In accordance with the preferred embodiment, the solenoid valves 64 are in electric communication with an electronic system controller 66 generally mounted near or on the enclosure of the water distribution manifold 60 as depicted in FIG. 2. The system controller 66 is fed with electricity through an electric cable 63 generally extending along the water supply line 62. The system controller 66 is in further electronic communication with a user interface 68 preferably, but not exclusively, mounted thereon. The user interface 68, which can take various configuration (e.g. motion detection, pressure sensor, tactile screen, etc.), allows a participant to activate the water play installation 10.

As depicted in FIGS. 2 and 3, the user interface 68 is preferably integrated in the top of the command center 50 in a manner to make the user interface 68 accessible to participants. Still, the user interface 68 could be located substantially outside of the enclosure 52. For instance, the user interface 68 could be mounted to a post or structure (not shown) extending outside the enclosure 52 via the opening 57 of the cover 58. Understandably, the exact configuration of the user interface 68 can vary; the present invention is generally not limited to any particular configuration.

As a participant interacts with the user interface 68, the interface 68 will send one or more electric signals to the system controller 66. The system controller 66 will, in response and according to a predetermined program stored therein, turn on or off the solenoid valves 64 such that the water dispensing elements 30 are selectively provided with water.

The skilled addressee will understand that the system controller 66 can comprise several predetermined programs which can be run sequentially or randomly. In addition, depending on the user interface 68 and the system controller 66, the system controller 66 could react differently to different stimuli provided to the user interface 68. The present invention is not so limited.

As the skilled addressee will understand, the system controller 66 can be of various configurations. Typically, but not exclusively, the system controller 66 will comprise a processing unit such as a micro-controller in electronic communication with both the user interface 68, for receiving input signals therefrom, and the solenoid valves 64, for providing actuation signals thereto. The system controller 66 will also typically comprise data storage units such as electronic memory chips, in electronic communication with the processing unit, for storing one or more predetermined programs of activation of the water dispensing elements 30. The system controller 66 could also be provided with input/output ports such as USB or RS232 ports and/or with a wireless transceiver, any of which would be in electronic communication with the processing unit. Such ports and/or transceiver would allow the upload and download of data (e.g. new water dispensing programs, maintenance data, system update, etc.) to and from the system controller 66. The present invention is however not so limited.

As water is dispensed by the water dispensing elements, water accumulates at the surface of the water play area 20. In order to prevent dangerous accumulation of water, a drainage system (e.g. drainage holes 59) is preferably integrated in the top cover 58 of the enclosure 52.

As best depicted in FIG. 2, the side wall or walls 56 of the enclosure 52 are also provided with one or more drain pipes 70. Hence, as water accumulates inside the enclosure 52, the water flows down the drain pipes to a sewage water collecting pipe or, preferably, to a water treatment system where the water can be treated and preferably recycled back through the installation 10.

Understandably, since the user interface 68, the system controller 66, the water distribution manifold 60 and the solenoid valves 64 will be exposed to water during normal use of the installation 10, it is most preferred that these components be made with water and corrosion-resistant materials (e.g. plastics, aluminium, stainless steel, etc.) and/or be made to be water proof with the use of sealed electrical connections and waterproof electrical enclosures (e.g. covered by elastomeric membranes, coated with sealant, etc.).

By being located close to the water play area 20 and preferably centrally located underneath the water play area 20, the command center 50 can integrate several functions and requires less water pipes and electrical wiring. Also, the overall water play installation 10 has a smaller footprint. In addition, since most of the components (i.e. user interface 68, the system controller 66, the distribution manifold 60 and the valves 64) of the installation 10 are located in the command center 50, maintenance of the installation 10 is simplified since most of the components are accessible through the removable cover 58.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A water play installation comprising:

a) a water play area;

b) at least one water dispensing element disposed on said water play area;

c) a command center located underneath said water play area, said command center comprising:

i) an enclosure defining an inner space;

ii) a water distribution manifold located in said inner space, said manifold comprising at least one inlet fluidly connected to a water source and at least one outlet;

iii) at least one electrically-actuated valve located in said inner space and fluidly connected to said at least one outlet and adapted to be in fluid communication with said at least one water dispensing element;

iv) a system controller located in said inner space, said system controller being in electronic communication with said at least one valve for providing actuation signals thereto;

d) at least one user interface in electronic communication with said system controller and adapted to receive input commands from at least one human and for transmitting input signals to said system controller.

2. A water play installation as claimed in claim 1, wherein said installation comprises a plurality of water dispensing elements, wherein said water distribution manifold comprises a plurality of outlets and wherein said command center comprises a plurality of electrically-actuated valves, whereby said valves are respectively in fluid communication with one of said outlets and one of said water dispensing elements.

3. A water play installation as claimed in claim 2, wherein said valves are electrically-actuated by solenoids.

4. A water play installation as claimed in claim 2, wherein said system controller comprises a processing unit in electronic communication with said at least one user interface and with said valves.

5. A water play installation as claimed in claim 4, wherein said system controller is configured to selectively actuate said valves according to at least one predetermined program.

6. A water play installation as claimed in claim 5, wherein said system controller further comprises at least one memory unit, and wherein said at least one program is stored on said at least one memory unit.

7. A water play installation as claimed in claim 2, wherein said system controller selectively actuates said valves upon receiving said input signals.

8. A water play installation as claimed in claim 1, wherein said enclosure comprises a bottom wall, at least one side wall and a cover.

9. A water play installation as claimed in claim 8, wherein said cover comprises at least one opening.

10. A water play installation as claimed in claim 1, wherein said water play area has a central region and wherein said command center is substantially located in said central region.

11. A command center for use with a water play installation, said command center comprising:

a) an enclosure defining an inner space;

b) a water distribution manifold located in said inner space, said manifold comprising at least one inlet for connection to a water source and a plurality of outlets;

c) a plurality of electrically-actuated valve located in said inner space and connected to said plurality of outlets and for connection with a plurality of water dispensing elements;

d) a system controller located in said inner space, said system controller being in electronic communication with said plurality of valves for providing actuation signals thereto;

e) at least one user interface in electronic communication with said system controller and adapted to receive input commands from at least one human and for transmitting input signals to said system controller;

whereby upon receiving said input signals from said at least one user interface, said system controller selectively actuates said plurality of valves in accordance to at least one predetermined program.

12. A command center as claimed 11, wherein said valves are electrically-actuated by solenoids.

13. A command center as claimed in claim 11, wherein said system controller comprises a processing unit in electronic communication with said at least one user interface and said valves.

14. A command center as claimed in claim 13, wherein said system controller further comprises at least one memory unit, said at least one memory unit having stored therein said at least one predetermined program.

15. A water play installation comprising:

a) a water play area;

b) at least one water dispensing element disposed on said water play area;

c) a command center located underground in close proximity to the periphery of said water play area, said command center comprising:

i) an enclosure defining an inner space;

ii) a water distribution manifold located in said inner space, said manifold comprising at least one inlet fluidly connected to a water source and at least one outlet;

iii) at least one electrically-actuated valve located in said inner space and fluidly connected to said at least one outlet and adapted to be in fluid communication with said at least one water dispensing element;

iv) a system controller located in said inner space, said system controller being in electronic communication with said at least one valve for providing actuation signals thereto;

d) at least one user interface in electronic communication with said system controller and adapted to receive input commands from at least one human and for transmitting input signals to said system controller.

16. A command center as claimed in claim 15, wherein said command center is located within 10 meters of said periphery of said water play area.

17. A command center as claimed in claim 15, wherein said command center is located within 5 meters of said periphery of said water play area.

18. A command center as claimed in claim 15, wherein said command center is located within 1 meter of said periphery of said water play area.

* * * * *